United States Patent [19]

Brumfield

[11] Patent Number: 4,608,716

[45] Date of Patent: Sep. 2, 1986

[54] SAFETY JUMP SUIT UNIFORM AND LIFTING MECHANISM FOR MINERS AND OTHER WORKERS

[76] Inventor: Michael Brumfield, 375 C Rte. 2, Lewisburg, W. Va. 24901

[21] Appl. No.: 409,979

[22] Filed: Aug. 20, 1982

[51] Int. Cl.[4] ..... F41H 1/02; F41D 13/00

[52] U.S. Cl. ..... 2/2.5; 2/411; 2/69; 2/79; 2/44; 2/102; 2/403

[58] Field of Search ..... 2/69, 2, 2.1 R, 2.1 A, 2/227, 102, 93, 94, 79, 2.5, 411, 403, 44, 45

[56] References Cited

U.S. PATENT DOCUMENTS

| | | | |
|---|---|---|---|
| Re. 29,742 | 9/1978 | Tung . | |
| 836,802 | 11/1906 | Daniel . | |
| 903,403 | 11/1908 | Armstrong et al. . | |
| 1,098,492 | 6/1914 | Gibson . | |
| 1,184,785 | 5/1916 | Stern . | |
| 1,239,980 | 11/1917 | Stewart . | |
| 1,371,690 | 3/1921 | Kelly . | |
| 1,746,067 | 2/1930 | Zwalley . | |
| 2,287,821 | 6/1942 | O'Donovan . | |
| 2,739,311 | 3/1956 | Bullard . | |
| 3,154,072 | 10/1964 | Mack . | |
| 3,171,409 | 3/1965 | Cetrone . | |
| 3,183,443 | 5/1965 | Lefevre . | |
| 3,189,917 | 6/1965 | Sims . | |
| 3,307,535 | 3/1967 | Locke . | |
| 3,480,968 | 12/1969 | Scarf | 2/79 |
| 3,496,572 | 2/1970 | Herzig . | |
| 3,497,872 | 3/1970 | Mitchell . | |
| 3,502,073 | 3/1970 | Stanley . | |
| 3,605,118 | 9/1971 | Elin | 2/79 |
| 3,657,739 | 4/1972 | Holmes, Sr. . | |
| 3,717,143 | 2/1973 | Johnson . | |
| 3,849,804 | 11/1974 | Rakow . | |
| 4,048,991 | 10/1977 | Marx . | |
| 4,117,552 | 10/1978 | Simpson . | |
| 4,172,454 | 10/1979 | Warncke . | |
| 4,195,362 | 4/1980 | Rolando . | |
| 4,198,708 | 4/1980 | Fugere et al. . | |
| 4,211,813 | 7/1980 | Gravisse et al. . | |
| 4,464,795 | 8/1980 | Long et al. | 2/79 X |

OTHER PUBLICATIONS

"Ergonomics-Human Factors in Mining," Bureau of Mines Information Circular/1981, IC 8866, U.S. Department of the Interior.

"NILEC J Standard For the Ballistic Resistance of Police Body Armor," (Dec., 1978), U.S. Department of Justice.

"Protecting Society's Protectors," Reprint from DuPont Magazine Apr., 1980.

Lepper, Bernard J., "Lightweight Body Armor: The Police Officer's Preventive Medicine," (Feb., 1981), Reprint from Law & Order.

Ayoob, Massad F., "The Blunt Truth About Blunt Trauma," Reprint from Law & Order Magazine, (Aug., 1978).

Miner, Louis H., "The Ballistic Resistance of Fabrics of Kevlar® Aramid Fiber-Their Care and Use," A-37, (Apr., 1980), E. I. Du Pont de Nemours Co., Inc.

Olson, Richard L., "A Case For Bulletproof Vests" (Dec., 1980) Reprint from Law & Order.

*Primary Examiner*—H. Hampton Hunter

*Attorney, Agent, or Firm*—Fisher, Christen & Sabol

[57] ABSTRACT

A one-piece garment device containing safety features to help prevent injuries to miners and other workers. A lifting assistance mechanism is incorporated. Special gloves, shoes and helmets are used in conjunction with the safety device. The garment device is useful for military applications, heavy industrial applications and the like.

18 Claims, 10 Drawing Figures

FIG. 9
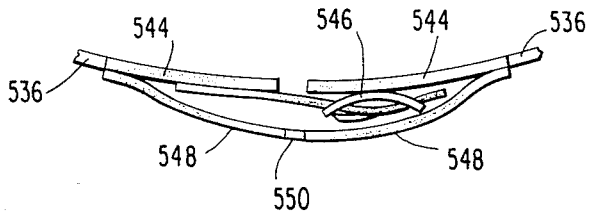
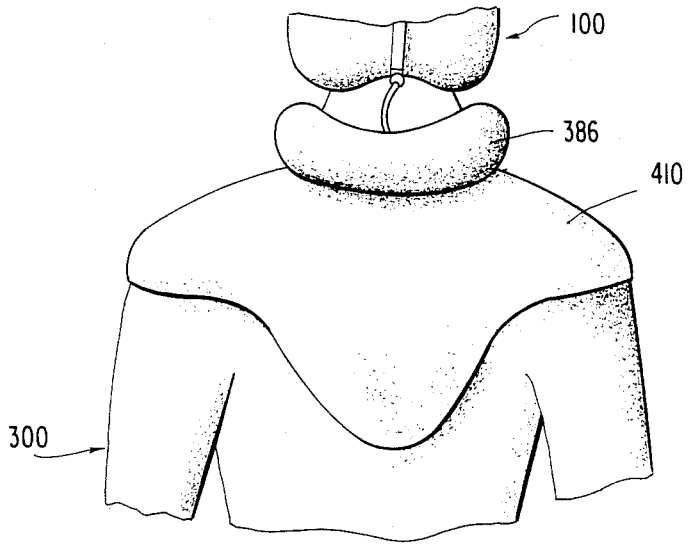
FIG. 10

SAFETY JUMP SUIT UNIFORM AND LIFTING MECHANISM FOR MINERS AND OTHER WORKERS

BACKGROUND OF THIS INVENTION

This invention relates to safety and injury clothing and devices for miners and other heavy industrial workers, and for military applications.

BROAD DESCRIPTION OF THIS INVENTION

An object of this invention is to provide a one-piece garment containing safety and injury-preventative features for miners and other industrial workers. Another object of this invention is to provide a one-piece garment for military applications which protects the soldier or policeman from the stress-strain associated with military and police combat maneuvers. A further object of this invention is to provide a safety helmet. A still further object of this invention is to provide a combination to protect parts of the human body from external forces applied thereto and from the stresses and strains applied thereto by heavy lifting, work or the like. Other objects and advantages of this invention are set out herein or are obvious herefrom to one ordinarily skilled in the art.

The objects and advantages of this invention are achieved by the garments, devices and combinations of this invention under heavy industrial, military combat or the like conditions.

This invention basically involves a combination of several interrelated and cooperating parts, but several of the parts are useful by themselves.

A specially designed jump suit uniform for the mining, heavy industries, and military occupations which require or afflict extreme and undue stress upon the human frame causing multiple stress and reoccuring injuries is disclosed. For prevention of these injuries, a specially designed jump suit is provided for the mining and heavy industries occupations which require extreme and undue stress upon the human frame causing multiple stress and strain reoccurring injuries. For prevention of such injuries, all major joint areas are supported with sewn-in supports and with heavy padding on those joints which receive abrasive forces. All of the hinged joints are given flexible stays for maximum ease of freedom of movement. A special lifting mechanism is incorporated to aid in lifting and prolonged bending since they are most common actions of injuries. The uniform incorporates a new complete lighting system to give more far- and near-vision and to increase the user's peripheral vision. The lighting system can include an infrared lighting source to be used in conjunction with special night vision goggles. The bottom half of the uniform is waterproof and designed for operation in an average temperature of 55° F. The concept of the uniform should incorporate all of the items mentioned for maximum protection and efficiency and none of the features of themselves will prevent the type of injuries occurring. But the uniform used as a total unit will greatly reduce the present rate of injuries thereby making a more effective work force and significantly decreasing lost time-injuries.

This invention involves a body-fitting device for aiding the user, for example, miner, heavy industry worker and military personnel, during lifting or prolonged bending. One version of the lifting device includes a pants or drawers section shaped for fitting over the lower torso. The pants section has a reinforced segment around its top rim and a vertical opening which extends part of the way down the front portion thereof, thereby allowing easy removal or donning of the lower torso section. The vertical opening has closure means capable of providing temporary and secure closure. There is an upper section shaped for fitting around the chest region of the upper torso. The upper torso section has a vertical opening which extends down the entire front portion thereof. The vertical opening has closure means capable of providing temporary and secure closure. There are two strap means which have their bottom edges attached to the top rim of the back portion of the lower torso section. The center portion of each strap means is attached in a slidable or movable manner to the back portion of the upper torso section. The upper portion of each strap means loops over the top of the upper torso section from the back portion thereof to the front portion thereof, thereby forming a shoulder strap section. An adjustable attachment means is mounted on each of the front portions of the upper torso section. The adjustable attachment means are for adjustably attaching the front part of the upper portion of each strap means to one of the front portions of the upper torso section. Preferably the closure means for the lower torso section and for the upper torso section is a zipper. Also preferably there is an elastic segment in the upper torso section located under either or both arms of the user. The adjustable attachment means preferably are buckles, but any other suitable adjustable fasteners can be used. Each of the strap means preferably contains one or more elastic segments situated in the back region of the user. Such version of the lifting device is normally used in combination with a one-piece outer garment, but can be used by itself if it contains its own closure means for the upper and lower torso sections.

This invention also includes a one-piece garment device containing safety and injury-prevention features, as stated above, this combination is the most advantageous as regards injury prevention. The device includes a one-piece garment having full sleeves and legs. The one-piece garment has a vertical opening in the front portion thereof which extends from the neck opening thereof to the crotch region thereof. There is closure means associated with the vertical opening capable of providing temporary and secure closure of the vertical opening. A pants or drawers section is shaped for fitting over the lower torso, and has a reinforced segment around its top rim. A vertical opening extends part of the way down the front portion of the pants section, thereby allowing easy removal or donning of the lower torso section. The lower torso section is positioned inside of the one-piece garment. The closure means is also capable of providing temporary and secure closure of such vertical opening so that the front of the lower torso section is temporarily and securely attached to the front portion of the one-piece garment.

In one version the upper torso section has an upper section, shaped for fitting around the chest region of the upper torso, which has a vertical opening that extends down the entire front portion therof. The upper torso section is positioned inside of the one-piece garment. The closure means is further capable of providing temporary and secure closure of vertical opening so that the front of the upper torso section is temporarily and securely attached to the front portion of the one-piece garment. There are two strap means whose bottom edges are attached to the top rim of the back portion of the lower torso section. The center portion of each strap means is attached in a slidable or movable manner to the back portion of the upper torso section. The upper portion of each strap means looping over the top of the upper torso section from the back portion thereof to the front portion thereof, thereby forming a shoulder strap section. Adjustable attachment means is used for adjustably attaching the front part of the upper portion of each strap means to one of the front portions of upper torso section. Each of the two adjustable attachment means is mounted on one of the front portions of the upper torso section. Preferably the cosure means is a zipper capable of simultaneously closing the vertical openings. Elastic segments in the upper torso section are preferably used and are located under either or both arms of the user. The adjustable attachment means preferably are buckles, but any other suitable adjustable fasteners can be used. Also, preferably the strap means each contain one or more elastic segments situated in the back region of the user.

Support elements are located on each of the knee and elbow joint portions of the garment are especially advantageous features. Each of the support element is a flexible main sheet of heavy duty material with padding on part of the surface of the main sheet. Elastic material is located in the side and/or back joint bending portions of the main sheet. Preferably strap-buckle means are present to adjust the tension on the support elements, but other suitable adjustable fasteners can be used.

Apertures in the chest region of the one-piece garment which expose the adjustable attachment means are preferred features. Support elements are preferably located at the wrists, with each of the support elements having a flexible main sheet and strap-buckle means on the main sheet to adjust the tension on the support element. Other suitable adjustable fasteners can be used in place of the buckles. Preferably an adjustable utility belt is positioned around the waist region of the garment.

The preferred version of the lifting device (torso stress reduction device) is a unisex device. The preferred body-lifting device for aiding the user during lifting or prolonged bending includes a pants or drawers section shaped for fitting around the lower torso, the leg portions thereof not extending beyond the upper thigh region of the pants. The pants have a vertical opening which extends all of the way down the front portion thereof, thereby allowing easy removal or donning of the lower torso section. The pants are crotchless. There is a non-elastic, padded, reinforcement ring affixed around each of the leg openings. Each side of the front of the pants is upwardly extended with a decreasing vertical width to form strap segments. Elastic girdle means circumscribe and are affixed to the waist portion of the pants. The back region of the girdle means only is expandable in a vertical manner. The girdle means has a vertical opening which extends all of the way down the front portion thereof. There is adjustable attachment means for adjustably attaching together the front portions of the girdle means. There are two strap means, each being attached on its lower end to the top and back rim of one of the padded reinforcement rings. Each strap means criss-crosses each other in the back region of the body-fitting device and extends upwards and over the top region of the body-fitting device to mate with the top of one of the strap segments of the pants. The top portion of the strap means is non-elastic and the bottom portion of the strap means is elastic. There are also two adjustable attachment means for adjustably attaching the top end of the strap means to the top end of the strap segments of the pants.

Preferably the additional closure means of the bottom torso section is a zipper. Also preferably the several adjustable attachment means are buckles. A cushioned pad is preferably located on the inner side of the crossover point of the two strap means. Also, a cushioned pad is preferably located in the back of the device between the girdle means and the two strap means below their crossover point.

Such body-fitting device can be used by itself or with an outer jump suit (described herein). When used with such outer jump suit, additional closure means is provided for the opening of the girdle means and is located outside of the attachment means for the girdle slot.

The one-piece garment device used with the preferred version of the lifting device includes a one-piece garment having full sleeves and legs. The one-piece garment has vertical opening in the front portion thereof which extends from the neck opening thereof to the crotch region thereof. Closure means associated with the vertical opening is capable of providing temporary and secure closure of the vertical opening. A pants or drawers section shaped for fitting around the lower torso is present. The leg portions thereof does not extend beyond the upper thigh region of the pants. The pants have a vertical opening which extends all of the way down the front portion thereof, thereby allowing easy removal or donning of the lower torso section. The pants are crotchless. There is a non-elastic, padded, reinforcement ring affixed around each of the leg openings. Each side of the front of the pants is upwardly extended with a decreasing vertical width to form a strap segment. Elastic girdle means circumscribe and are affixed to the waist portion of the pants. The back region of the girdle means only is expandable in a vertical manner. The girdle means has a vertical opening which extends all of the way down the front portion thereof. There is adjustable attachment means for adjustably attaching together the front portions of the girdle means. There are two strap means, each being attached on its lower end to the top and back rim of one of the padded reinforcement rings. Each strap means criss-crosses each other in the back region of the body-fitting device and extends upwards and over the top region of the body-fitting device to mate with the top of one of the strap segments of the pants. The top portion of the strap means is non-elastic and the bottom portion of the strap means is elastic. There are two adjustable attachment means for adjustably attaching the top end of the strap means to the top end of the strap segments of the pants. Additional closure means is provided for the opening of said girdle means and is located outside of the attachment means. The closure means of the garment is also being capable of providing temporary and secure closure of vertical opening of the girdle means by interaction with one additional closure means so that the front of the girdle means is temporarily and securely attached to the front portion of the garment.

Preferably closure means is a zipper capable of simultaneously closing the three vertical openings.

A rechargeable battery pack is mounted on the utility belt to supply the electricity requirements of the safety device.

The jump suit can have fire resistant, retardant and/or fireproof qualities by being constructed of Nomex® or similar materials. The torso section of the jump suit can have an additional layer of Nomex® or similar material to increase its explosion and projectal resistant capabilities.

The jump suit or coveralls of this invention, broadly speaking, is a one-piece outer garment having sleeves. The phrase one-piece garment means that the garment is not composed of a separate shirt and a separate trousers or pants.

The user of the jump suit device of this invention can wear thermal underwear, "long Johns" or other undergarments as is needed for warmth or desired by the user.

This invention includes a safety helmet for miners and industrial workers and usually is used in conjunction with the jump suit device or garment of this invention. The safety helmet is rigid and has a rigid crown arrangement, which provides resistance to crushing as a result of a blow from a falling object hitting the top or side of the safety helmet.

The helmet, which is impact resistant, has two ear-covering segments extending below the ear lobes of the user and a back segment which extends to or below the base of the skull of the user. Each ear-covering segment has an ear hole therein. There is a front brim on the helmet. A front lamp is mounted on the front brim of the helmet or on the helmet above the front brim (or rim in case the helmet does not have a brim). Tubing is mounted onto the crown of the helmet and extends over the top ridge or crown of the helmet. The tubing extends from the front lamp to the back rim of the helmet. There are two side lamps, each being mounted on one of the ear-covering segments of the helmet above the ear hole therein. Two tubing segments are mounted on the top of the helmet, each extending from one of the side lamps to the main tubing. An electronic-pulsed and/or frequency variable signaling device or transmitter is mounted on the main tubing. The electronic signaling device is capable of periodically emitting an electrical signal which is capable of being detected by a receiver. Electrical cable is electrically connected to the front lamp, the two side lamps and the transmitter, and is located in and extends through the main tubing and the two tubing segments. An electrical connector is attached to the end of the electrical cable which exits out of the end of the main tubing. The electrical connector is resistant to accidental separation from electrical connection to an external electrical power sorce, preferably a storage battery or battery pack. Preferably the front lamp is capable of separate long-distance illumination and short-distance illumination, selection thereof being by a manual switch. Two or more snaps are preferably located around the edge of the front or facial portion of the helmet. A transparent facial and/or eye cover or mask can be attached to the front portion of the helmet by means of such snaps. Preferably the inner rim of the helmet is padded and one or more light-reflective stripes is painted or adhered to the helmet. A filter ear-protector preferably is mounted over the ear hole of each side ear-covering segment of the helmet. Such filter ear-protectors have a filter element which prevents the passage therethrough of dust particles of a size large enough to irritate or traumatize the ear channel. The helmet can also have several ventilation holes (and filters therefor) which can be lowered.

The facial and/or eye cover for the helmet can be fire retardant, resistant or proof. By putting an appropriate inner rubber sealing rim (which contacts the perimeter of the user's fact), the facial cover or plate can be used for protection against fire, toxic fumes, etc. In such a case the facial cover contains a nose or mouth piece connected to an oxygen tank to provide a self-contained respirator.

For military applications, the helmet can be provided with an outer steel shell having an optional detachable light.

Coal mining injuries today are a major problem which detrimentally affect, both directly and indirectly, the cost of production of coal and the lives of those individuals, management and employee alike involved in coal production. Over the past several years of practice, one has become increasingly aware of the alarming rate and severity of injury in coal industrial compensation settlements due to on-the-job injuries.

Injuries are usually divided into two basic categories, namely, (1) fatal and (2) non-fatal. According to most all statistical data studied to date, by far the largest single subcategory of the non-fatal injuries are the stress, strain, ruptured disc, both in frequency and cost. In a recent article from the United Press International, director Walter N. Miller reported, "75% of injuries which occur in state mines are not major. The largest percentage, 75% are back injuries in the stress, strain category." The U.S. Department of Labor, Mine Safety and Health Administration, in Denver, Colo. computer center indicates, according to my study, that stress and strain injuries are on the increase by 20 percent, especially as applied to the low back and, for example, under the subcategory of head/neck injuries, it is revealed that approximately 90 percent are related to stress, strain and ruptured disc. West Virginia Workmens Compensation statistics revealed that the coal mining industry accounts for only 5 percent of the West Virginia work force, but is responsible for 32 percent of all injuries recorded. The coal industry is accounting for 63 percent of all permanent partial disability awards and 59 percent of all permanent total disability awards given and yet only represents 5 percent of the total work force.

This problem can be reduced significantly by applying two basic concepts, namely, (1) by proper preplacement screening exams with special emphasis on structural integrity and (2) by proper protective and supportive apparel that is designed to reduce stress placed upon the individual miner.

(1) Proper preplacement screening exams with special emphasis upon structural integrity can better determine normal functional capacity of the future employee. Stress can be measured in the human body just as it can be measured in metal castings and machinery. It has been determined that individuals who are heavily stressed or have pre-existing weaknesses that reduce normal functional capacity within a particular anatomical area, will be injury prone if placed in a job situation that stresses that particular weakness. By predetermining potential anatomical injury sites, one can better place his or her employee in the best job situation that does not expose the employee to harmful stresses that affect his or her weakness, thus eliminating or reducing future injury possibilities. As example, an employee with 93 percent normal functional capacity or 7 percent lost of function in the lower extremities, will only be slightly subject to injury when placed in low coal as contrasted to an employee with a low back that is rated 60 percent normal or 40 percent lost of normal function and therefore greatly subject to injury if placed in low coal. The latter employee could be best placed in a job that does not require heavy lifting or prolonged bending thus allowing the company to benefit of his experience but reducing his injury possibility.

(2) Proper protective and supportive apparel designed to reduce stress on most frequent anatomical injury sites will be affective in reducing future injuries. The miner today, even though he may be physically fit for most industrial job situations, is being subjective to stresses that may injure the most healthy individual. Prolonged bending, lifting heavy weights in awkward positions, exposure to cool to cold temperatures in a wet environment, increase stress and fatigue factors well above normal. The invention jump suit includes adjustable elastical support systems for all major joints, but yet allowing freedom of movement, will reduce the affects of harmful stresses significantly. The invention suit also includes a lifting mechanism which will aid the employee in a lifting or prolonged bending position. Padding and protective materials are applied at the appropriate position of most frequent injury sites such as the knees, elbows, and shoulders which are subject to puncture or impact injury. The invention jump suit or uniform is designed to reduce temperature stresses as well as waterproofing to reduce the affects of moisture exposure. Other special consideration, for example, refective striping to increase miner visibility, and the above considerations, greatly increase comfort and the protection of the present day miner.

In summary, miners today are working in extreme discomfort and being subjected to an alarming number of injury possibilities without adequate protection. Because of abnormal stress factors, increased fatigue factors and exposure to unusual environmental factors, human error becomes a significant part of injury occurrence. A professional weight lifter would not lift a weight without a proper back support, why should one expect a professional miner to work without adequate protection.

DETAILED DESCRIPTION OF THIS INVENTION

In the drawings:

FIG. 9 is a partial top elevational view of the zipper attachment means for attaching the special body lifting device shown in FIG. 6 to the safety garment-device of this invention; and FIG. 10 is a back perspective view of an upper torso protective cover.

Figure 1:
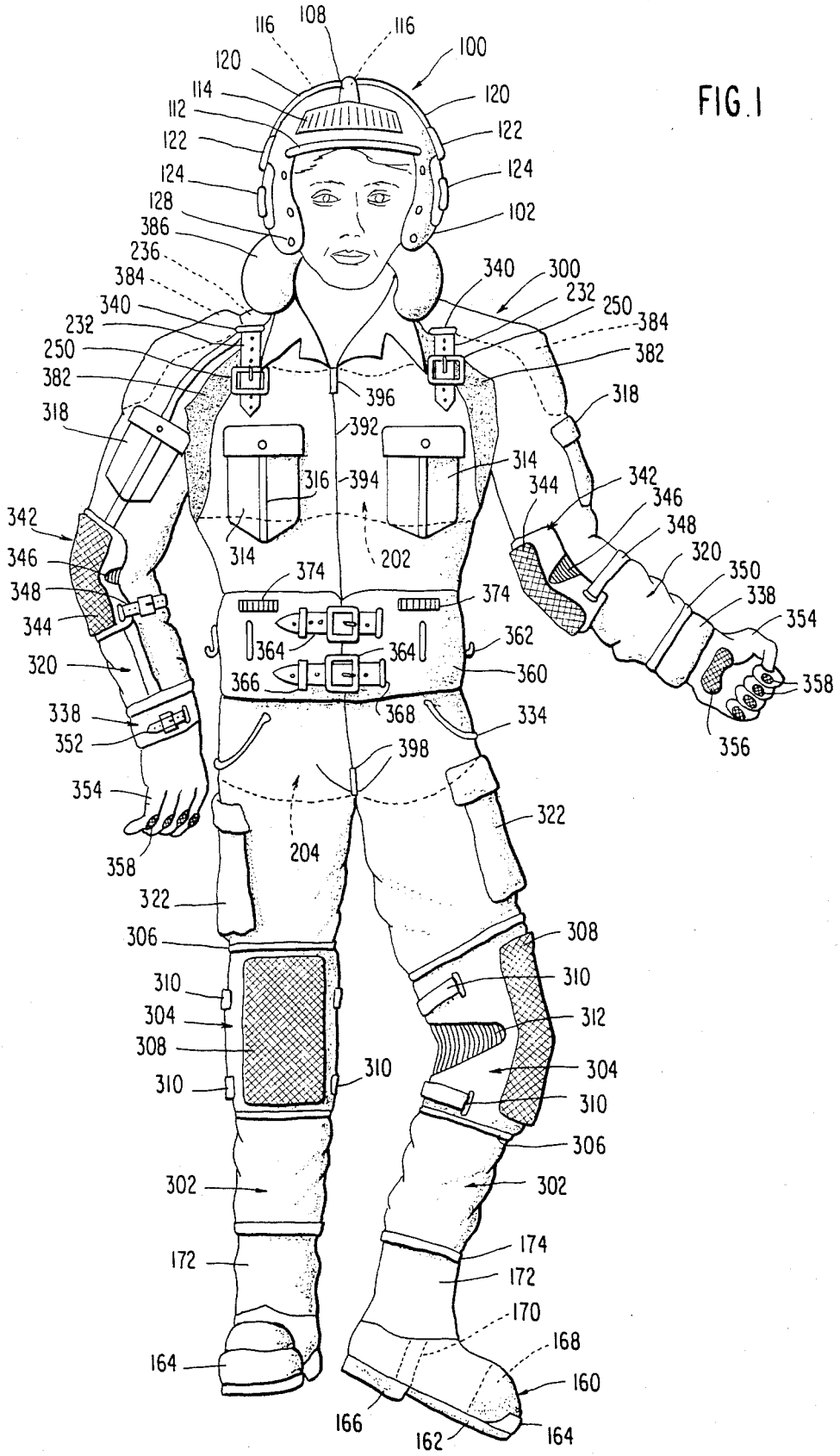
FIG. 1 is a front perspective view of the full safety garment-device of this invention on a user.
Figure 2:
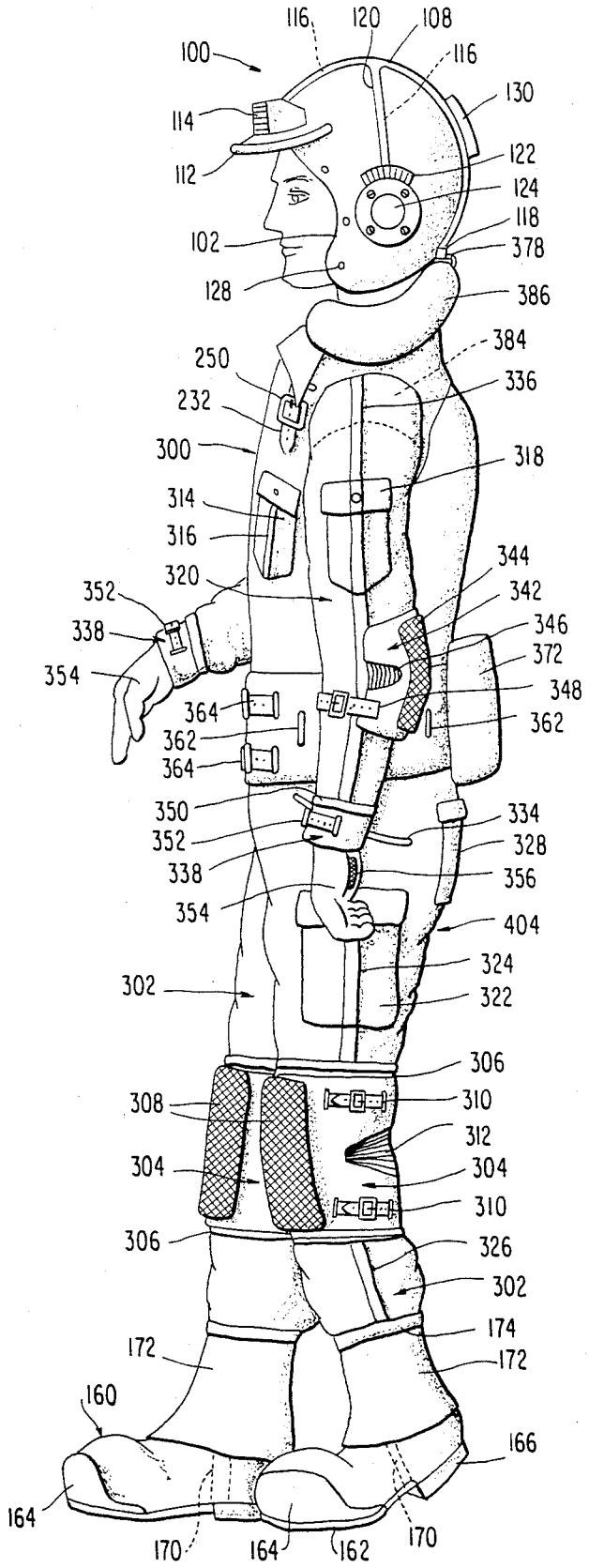
FIG. 2 is a side perspective view of the full safety garment-device shown in FIG. 1.
Figure 3:
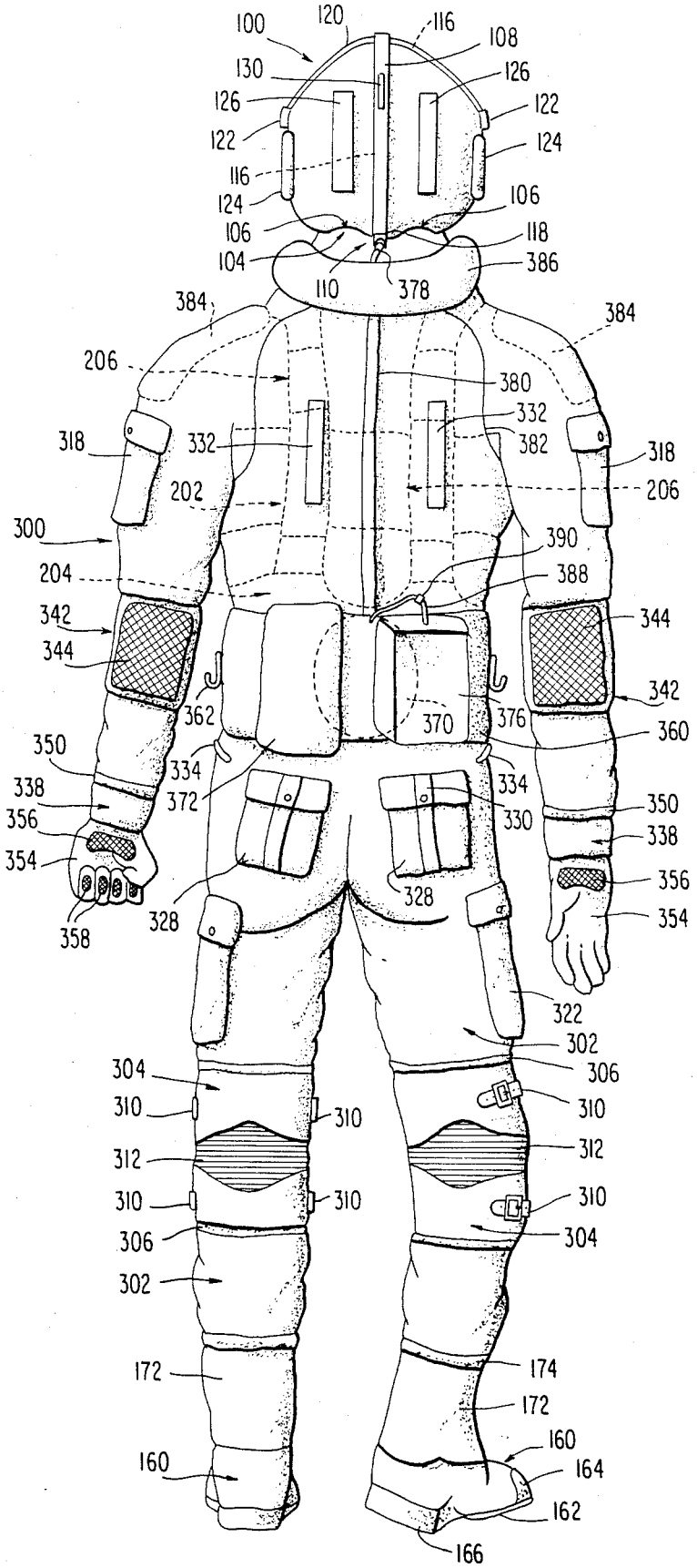
FIG. 3 is a back perspective view of the full safety garment-device shown in FIG. 1.

In FIG. 1, numeral 100 represents a safety helmet for use by miners and other workers in heavy industries and the like. Safety helmet 100 is of the bicycle-type. Helmet 100 is a protective head covering (i.e., covering or enclosing headpiece) having side ear-covering segments 102, which extend down below the ear lobes. As best shown in FIG. 3, the back side of helmet 100 merges the two side segments 102 so that back rim 104 generally traverses a horizontal line that corresponds to the intersection of the base of the skull and the top of the neck. Preferably rim 104 has single, full concave segment 106 located at the base of the skull. (There is not any apex on the rim of the helmet at the base of the skull for safety purposes.) Helmet tubing or conduit 108 is located on the top of helmet 100 following the ridge or central line of helmet 100 from back rim 104 to front region of helmet 100. Helmet tubing 108 is preferably about ½ inch in diameter and provides additional impact protection for the head. Helmet 100 contains front brim 112. Front lamp 114 is mounted on front brim 112 as shown in FIG. 2. (Front lamp 114 can be located in the vicinity of front brim 112 or, if there is not any front brim, at or in the vicinity of the front rim of helmet 100.) Front lamp 114 is a conventional or appropriate lamp (e.g., tungsten filament, halogen or sodium lamps) capable of long- and near-distance illumination, either of which can be switched to manually by the user. Such switching (not shown) can be located on helmet 100 or battery pack 376. Helmet tubing 108 contacts front lamp 114 where electrical cable or wiring 116 exits front lamp 114. Front lamp 114 is electrically connected to two wires of cable 116. Electrical cable 116 is located in helmet tubing 108. Electrical snap-fitting (female) connector 118 is attached to the end of electrical cable 116 exiting out off hole 110 in the end of tubing 108 at a position just below helmet rim 104. The two side or laterial helmet tubing or conduits 120 provide housing for the two lateral segments of cable 116, which are each electrically connected by two wires thereof to one of lateral area lamps 122—this is an optional feature. Each side segment 102 of helmet 100 has a conventional ear hole (not shown). Filter ear protectors 124 are located over the ear holes, and lateral area lamps 122 are located on side segment 102 just above filter ear protectors 124 located over the ear holes. Lateral area lamps 122 provide immediate area lighting and increase peripheral vision. Filter ear protectors 124 are optional and can be attached to the helmet by screws, snaps, etc., for easy removal and for changing or removing the filters. Filter ear protectors 124 protect the user from the trauma of dust intrusion in his ears and the like. The dust filter portion of filter ear protectors 124 can be composed of one or more filters, preferably with the filters getting finer towards the inside of helmet 100. The sole screen or inner filter should have a mesh of 350 or 400 in order to trap the air-borne dust particles and should be of silk or wire cloth or the like.

Light reflecting helmet stripings 126 (see FIG. 3) are constructed of conventional light reflective strips (can be glued on or can be of the adhesive tape type) and are used to aid and increase the visibility of the miner or user. Stripings 126 (see FIG. 2) can be painted on helmet 100 provided light reflective paint is used. Snaps 128 are located around the facial opening of helmet 100 to snap-connect a conventional eye-and-face protective shield (not shown) of clear plastic (shock resistant and/or fire resistant—retardant), or a pivotal-lift face protective shield, or a face protective shield with a built-in aspirator, or a mouth piece and mouth structure for self-contained air/oxygen, air generation units. Electronic-pulsed and/or frequency variable signaling device 130 is mounted on helmet tubing 108, but can be located any convenient place where it is not subject to damage from hitting something. Electronic-pulsed and/or frequency variable signaling device 130 (transmitter) sends out an impulse that can be electronically detected or received for the purposes of locating the miner or user in emergency situations and/or to monitor certain vital signs, e.g., heartbeat. Electronic signaling device 130 can be conventional electronic-pulsed and/or frequency variable signaling device and preferably emits a signal every 30 seconds or so that the signals of a number of users can be easily sorted electronically. Electronic signaling device 130 is electrically connected to a pair of wires of cable 116.

Helmet 100 is preferably of the molded material type with ribbed reinforcement, for example, having a smooth outer surface and being constructed thereunder by an inner layer or zone of high-duty high-intensity-impact plastic foam. Helmet 100 can also be, for example, fiber-reinforced plastic or formed from fibers adhered together. Helmet 100 must be very impact resistant and/or fire retardant material and/or covered with fire retardant material such as Nomex®.

The internal edges of the helmet can be padded. Helmet 100 can also contain a conventional head band supported or support means therein, but should not interfere with the snug fit caused by the internally-padded edges of helmet around the user's head. Helmet 100 has a shape that generally conforms to the shape of the head and has frontal opening for the user's face. Optionally a chin strap can be used with helmet 100. Also, optionally two to four appropriately-positioned louvered or ribbed ventilation vents (not shown) internally protected by a single screen or dust filter can be used on helmet 100.

Cable 116 can be one or more pair of wires depending upon how one desires to electrically connect or interconnect front lamp 114, side lamps 22 and signaling device to the power source (which is described below). Electrical snap-fitting connector 118 has as many separate electrical contacts as is required by the separate wires used in cable 116. Electrical snap-fitting connector 118 can be replaced by conventional plug type of electrical connectors, but they are less desirable since they can pull apart. Also, other electrical connectors can be used which have interconnecting means to prevent accidental separation but the snap-fitting connector is preferred. The use of tubing 108 and 120 helps prevent accidents that cut or disable cable 116 to front lamp 114 and side lamps 122. Tubings 108 and 120 form a reinforcing element for helmet 100.

Boots 160 are ankle-to-calf high, light weight and waterproof. Boots 160 each have flexible sole 162, and external high rubber, water proof or water resistant toeing 164 for aid in crawling and maximum traction to decrease "wear and tear" on the user. (Toeing 164 can also be Nomex® or the like). Boots 160 each also has rubber (or Nomex® or the like) heel 166 and internal steel toe 168. Adjustable elastic foot straps or ankle/-boot open heeled band supports 170, internally located, detachably or permanently attached to the lower portion of pants legs 302 of jump suit 300. Foot straps (or ankle/foot supports) 170 maintain and prevent the riding up of pants legs 302 and maintain the proper placement of knee supports 304 on the user legs, as well as provide ankle/foot support.

Boot covers (attachable flap) 172 are waterproof and cover the top of boots 160 for dust and water resistance and fire retardancy. Boot covers 172 are placed on the lower portions of the leg over the top of pants legs 302 and then boots 160 are put on. The lower part of boot covers are then brought down over the upper portions in an attaching and fitting manner (e.g., by snaps on boots 160 and boot covers 172). Boot covers 172 also cover the ankles. Boot covers 172 have rim reinforcements 174 which are constructed of a semi-rigid material (e.g., a flexible plastic ring within a fabric covering).

Figure 4:
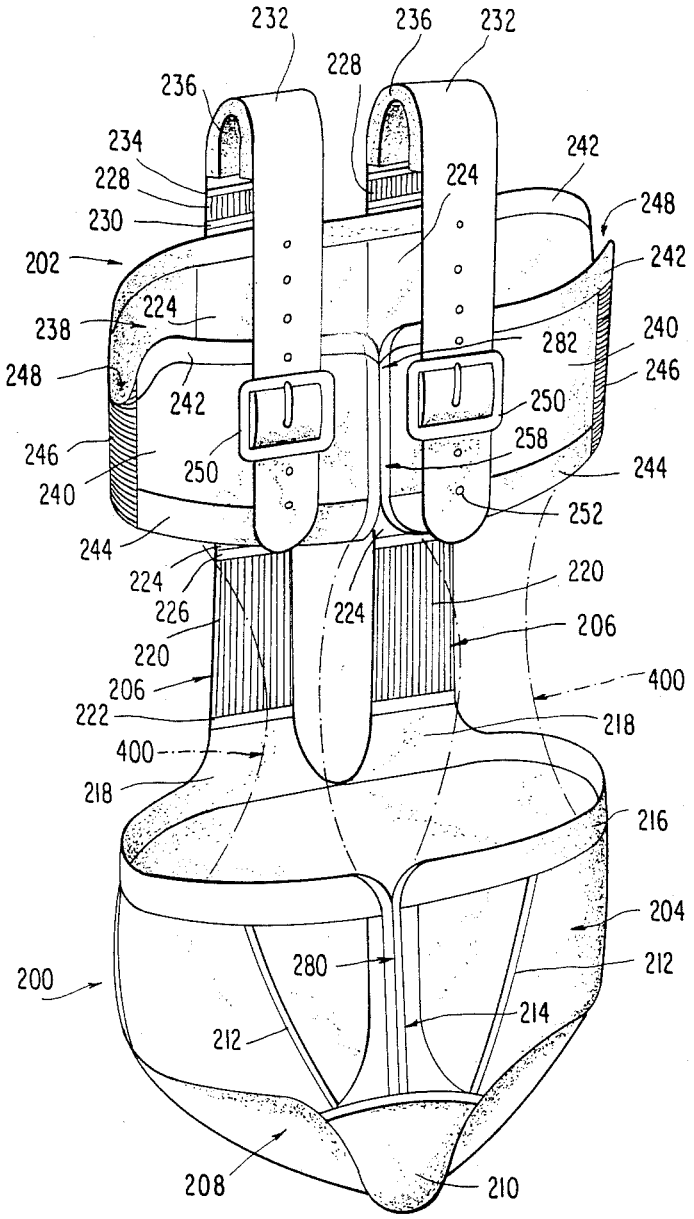
FIG. 4 is a front perspective view of one version of the special body lifting device of this invention.

In FIG. 4, numeral 200 represents one version of the "LIFT-O-MATIC" device of this invention, which acts as a lifting assistance mechanism. Support device 200 includes upper torso body girdling (support) device 202 and lower torso body girdling (support) device 204. Both support-attachment straps 206 interconnect the back sides of upper torso device 202 and lower torso device 204. Lower torso device 204 generally has the shape of shorts, having leg openings 208, and is made of or lined by a cloth such as cotton so as to be comfortable for the user. Lower torso device 204 is also termed a lower pelvic girdle support and acts as a lower stay of lifting device 200. The size of lower torso device 204 is made to fit the individual user. Lower torso device 204 contains gential protection segment 210 (made of a slightly heavier material for firmness) when the user is a male. Lower torso device 204 also contains vertical reinforcing elements 212 (e.g., plastic strip or layers of strips of cloth) to aid the endurance of the user. Anterial vertical opening segment 214 of lower torso device 204 is described below in more detail.

The upper rim of lower torso device 204 is reinforcing band 216, which is made of a heavier fabric such as a canvas-like fabric or reinforced elastic material. Reinforcing band 216 adds unity to the lower mechanism (lower torso device 204). Lower attachment segments 218 of lifting straps 206 can be attached (sewn) to reinforcing band 216 or, preferably, can be an integral part of reinforcing band 216. Lower attachment segments 218 widen out to almost the complete width of the back portion of lower torso device 204 in order to give maximum support during lifting and bending by the user.

The bottom edge of each lower flexible or elastic segment 220 is (heavy-duty) attached to the top edge of a lower attachment segment 218—attachment typically is by multiple (preferably triple) rows of stitching at numeral 222. Lower elastic segments 220 are preferably made of heavy elastic (give) material for the purpose of support and give during the motions of prolonged bending and heavy lifting by the user. The top edge of each lower elastic segment 220 is (heavy-duty) attached to the bottom edge of a middle strap segment 224. Such attachment typically is by multiple (preferably triple) rows of stitching at numeral 226. Middle strap segments 224 are preferably made of a heavy fabric such as a canvas-like fabric. The upper edge of each middle strap segment 224 is (heavy duty) attached to the bottom edge of an upper elastic segment 228. Such attachment typically is by multiple (preferably triple) rows of stitching at numeral 230. Upper elastic segments 228 are preferably made of a heavy elastic (give) material for the purpose of support and give during the motions of prolonged bending and heavy lifting by the user. The top edge of each upper elastic segments 228 is (heavy duty) attached to the bottom edge of a shoulder strap 232. Such attachment typically is by multiple (preferably triple) rows of stitching at numeral 234. Shoulder straps 232 are preferably made of a heavy non-elastic fabric, e.g., a canvas-like fabric, or leather.

Each lifting strap 206 is composed of a lower attachment segment 218, a lower elastic segment 220, a middle strap segment 224, an upper elastic segment 228 and a shoulder strap 232.

Shoulder straps 232 are preferably about 2½ inches wide of a non-elastic material—other widths can be used. Padding 236 is attached under shoulder straps 232 where the latter traverses the user's shoulders. Padding 236 is preferably about ½ inch thick of a high-density resilient plastic foam but can be felt material or the like. Paddings 236 are preferably sewn to the underside of shoulder straps 232. Padding 232 serves for weight and stress protection of the shoulder area.

Upper torso device 202 is also termed an upper chest body support and acts as an upper stay of lifting device (mechanism) 200. The height of upper torso device is usually about 6 to 10 inches, varying according to the size of the user. Upper torso device 202 has back segment 238 and two front segments 240. Back segment 238 and two front segments 240 are preferably made of a heavy non-elastic fabric, e.g., a canvas-like fabric, in which case the three segments 238 and 240 are preferably lined with a light fabric such as a cotton fabric. The upper edge of each of the three segments 238 and 240 contains reinforcing strip 242, the internal surface of which contains padding—this aids the unity of support and provides protection against chaffing of the user. The lower edge of each of the three segments 238 and 240 contains reinforcing strip 244, the internal surface of which contains padding—this aids the unity of support and provides protection against the chaffing of the user.

Each of front segment 240 are affixed to back segment 238 of upper torso device 202 by intermediate elastic segments 246. Elastic segments 246 allow freedom of breathing and motion. Depressions 248 are formed by curving the upper ends of the three 238 and 240 and continuing with a concave upper edge of the upper edge of each elastic segment 246—see FIGS. 4 and 5. Depressions 248 allow free movement of arms and prevent binding and riding against the underarm.

An adjustable buckle or other fastener 250 is attached to the front of a front segment 240 and cooperates in an adjustable fastening manner with holes 252 on the front end of a shoulder strap 232. Adjustable buckles 250 allow different tension strengths (values) from none to maximum depending on the activity and preference of the user. During heavy lifting or prolonged bending, shoulder straps 232 can be tightened to maximum tension for maximum support. When the user is in the crawling position or a position of less desired or needed support, the shoulder strap can be loosened (tension lessened) to allow total freedom of movement.

Figure 5:
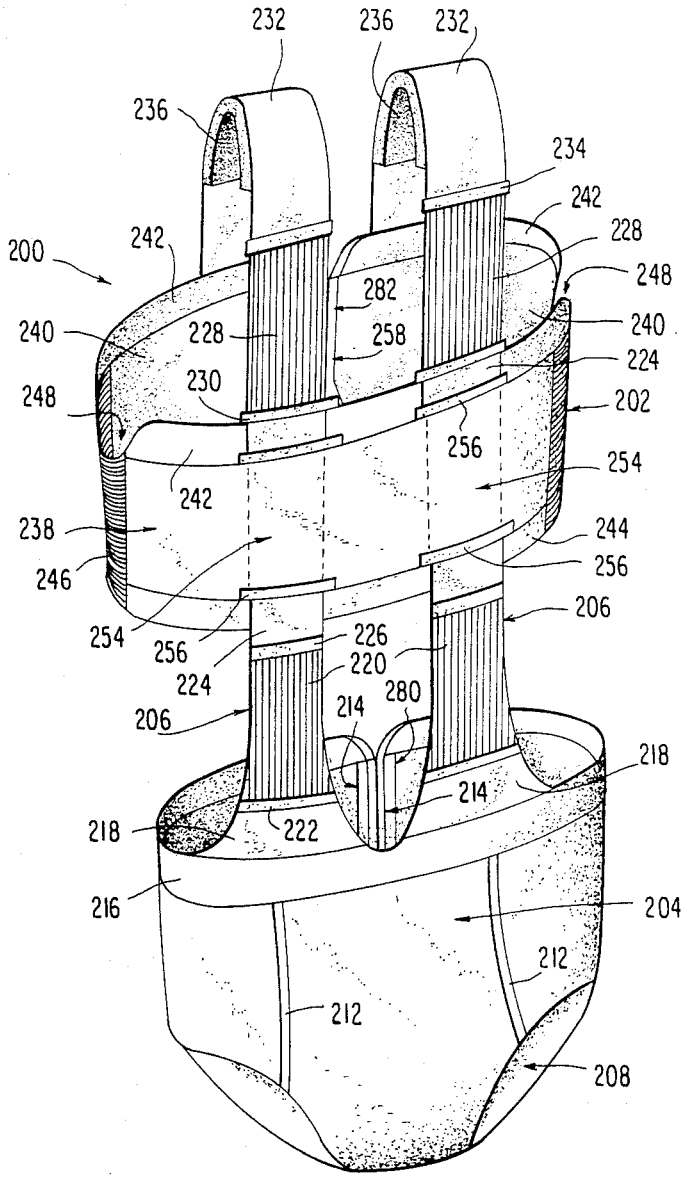
FIG. 5 is a back perspective view of the special body lifting device shown in FIG. 4.

Back segment 238 contains four slits the width of a middle strap segment 224. As shown in FIG. 5, a pair of such slits is positioned below reinforcing strip 242 and the other pair of such slits is positioned above reinforcing strip 244. The slits are aligned to allow the insertion of middle strip segments 224 therethrough to form a sleeve mechanism, generally indicated by the numeral 254. This sleeve mechanism allows the controlled movement of shoulder straps 232 and constant positioning. Each of the slits is reinforced by reinforcing strip 256 at the slit (opening).

Anterior vertical opening segment 258 of upper torso device is described below in more detail.

As shown in FIG. 4 by dotted lines, two non-elastic anterior straps 400 attached to reinforcing band 216 of lower torso section 204 and to reinforcing band 244 of upper torso section 202 prevent the riding up of upper torso section 202.

In FIG. 1, numeral 300 represents the outer jump suit of safety garment device of this invention. Knee supports 304 comprises a sleeve of heavy duty durable material, preferably a fabric such as a canvas-like material, or Nomex ®. Knee supports 304 are attached to pants legs 320 by means of seams 306—attachment is preferably by one or more line of stitching. Knee covering material 308 is mounted on the outer surface of knee supports 304 over the knee and is made of a semi-flexible, durable and abrasion-resistant material. Knee covering material is normally sheet shaped with a width of about 6 inches and a length of about 10 inches. Two knee support strappings 310, adjustable by means of buckles shown in FIGS. 1 to 3, are used on each side of knee support 304 for support of the knee joint structure and adjustment of the support. On each side of the knee, one of the knee support strappings 310 is located above the knee joint and one below it. Flexible or elastic give segment 312 is located in knee support 304 behind the knee in the bend of the leg. Elastic give segment 312 provide maximum flexability and movement of knee structure or support 304. Knee support 304 includes padding (not shown) over the knee (generally under knee covering material 308). Such padding is preferably a high density flexible plastic foam (or belt or the like) insert about one inch thick. Knee support 304 provides comfort and protection during crawling and placing weight on the knee structure.

Anterior pockets 314, with snap closure, are located on the chest region of jump suit 300. Light reflecting striping 316 is located on anterior pocket 314 for increased visibility of the user. Side pockets 318, having snap closure, are located on arms 320 or jump suit 300. Side leg pockets 322, having snap closure, are about 5 inches in width and about 9 inches in depth. Light reflecting striping 324 is located on pocket 322 and the side of pants leg 302. Light reflecting striping 326 is located on the lower side part of pants leg 302. Rear pockets 328 have snap closure and light reflective striping 330. Light reflecting striping 332 is mounted on the back of jump suit 300. Pockets 334 are located anterior the pelvic position. Light reflective striping 336 runs the length of arm 320 from top to wrist support 338.

FIG. 1 shows reinforcing guard 340 which allows shoulder strap 232 to exit from under the shirt portion of jump suit 300. Buckles 250 also stick through holes in the shirt portion of jump suit 300. This allows easy external adjustment.

Elbow supports 343 are made of a protective material, such as, canvas-like fabric, Nomex ®, or the like, to protect the elbow joints when the elbows are used for support or leverage and they prevent cutting and wear on the elbows. Elbow padding 344 is mounted over the elbow to cushion the elbow and are sewn into place by multiple stitching. Elastic give 346 of elbow support 342 allows maximum flexability of the elbow joint. Forearm buckle adjustment 348 adds to the support and reduces stress during crawling or while the user is on his hands and knees.

Wrist support 338 supports the wrist structure and forearm especially while crawling. Wrist support 338 is preferably about 2 inches wide and is made of a flexible heavy duty material, such as, canvas-like fabric, leather, heavy duty elastic or the like. Reinforced seam 350 connects wrist support 338 to sleeve 320. Wrist strap 353 is for adjusting wrist support 338 to prevent carpal tunnel syndrome and to support the wrist and arm while crawling.

Work gloves 354 are designed for crawling yet give complete freedom of movement. Work glove heel guard 356 comprises a pad preferably of about ½ inch (or less) thick high density plastic foam (or felt or Nomex ® or the like) of about 1 inch in length and about 2 inches in width. Heel guard 356 provides protection for the heel of the hand and resists stress transmitted to the arm. Finger guards (pads) 358 protect the hands and fingers during crawling. Pads 358 are preferably made of ¼ inch thick high density foam (about ¾ inch long and ½ inch wide), felt, Nomex ® or the like, and are sewn into the work glove.

Lumbosacral waist support and utility belt 360 provides for lifting protection and is used for the mechanical attachment of necessary equipment. Belt 360 is made of a flexible high tensile material for maximum endurance and is usually 6 to 12 inches in height according to the size of the user. Hook attachments or other fastening means 362 are spaced around utility belt 360 for hooking or attaching equipment or tools to the waist. Lumbosacral adjustment straps 364 are for adjustment of tension of the lumbar and for waist support. Loop 366 is for fastening the lubosacral support strapping. Reinforcement 368 is for the lumbosacral support strapping. Lumbosacral support pad 370 is located within the lining of utility belt 360. Support pad 370 aids in maintaining normal lumbar curve during lifting and bending. Pad 370 is preferably about 5 inches in circumference, about one inch thick and made of high density foam or other suitable material Respirator 372 is attached to the back of utility belt 360. Two optional anterior belt lamps 374 are attached to utility belt 360 for increased visibility of the immediate working area and they allow better placement of footing.

Rechargeable battery or battery pack 376 is mounted on the back of utility belt 360 and provides electrical power for the various lights, lamps and transmitter. Male connector 456 of electrical cable 378 mates with female connector 118 of electrical cable 116. Electrical cable 378 is electrically connected to battery pack 376 by means of electrical connector 390, thereby provides electricity from battery pack 376 to lamps 114 and 122. Both ends of electrical cable 378 are coiled as shown in FIG. 3. Cloth sleeve 380 provides a conduit for cable 378 up the back of jump suit 300. Electrical cable 450 is electrically connected to battery pack 376 by means of electrical connector 452. Electrical cable 450 is run into hole 454 in belt 360 and then branches to both front lamps 374.

Both respirator 372 and battery pack 376 can be mounted on a wire or strip (not shown) which is horizontally situated and is mounted on each end to belt 334 on the side of the miner—this allows both items to be moved to side when the miner is on his back, etc.

The use of elastic cloth 382 under the arms, in the shoulders, etc., of jump suit 300 allows maximum freedom of movement of the arms. Shoulder pads 384 are located under jump suit 300 and underlap shoulder straps 232. An internal lining of soft cloth can be used. Shoulder pads 384 are for the protection from impact injury, for carrying heavy objects and for protection of the acromioglenohumeral joint. Shoulder pads 384 are comprised of 1 inch thick high density foam or other suitable material. The garment of this invention can be made of material that allows ventilation of the arm pits and/or inclusion of small ventilation openings.

Shoulder padding 384 is incorporated within the uniform across the shoulder. Shoulder pad 384 is placed within a sleeve so it can be removed for washing or replacement. Most padding within the uniform, etc. (as the low back pad) may be removed for washing. Each sleeve would be internally placed within the uniform with a snap closure. Shoulder strap 232 of the lifting mechanism slides over the padding of the shoulder through another sleeve device, namely, the exterior cloth and an interior cloth.

Cervical collar 386 is snap-on and removable to the collar region of jump suit 300. Cervical collar 386 prevents cervical trauma (whiplash insult, etc.) and is preferably about 3 inch thick dense foam with a cover having snaps.

Jump suit device 300 has vertical front opening 392 in which there is mounted two-way zipper closure 394. Zipper closure 394 has the zipper (slide) fasteners 396 and 398 on the zipper track to allow partial or complete opening of vertical front opening 392 as desired or needed. This allows easy removal of jump suit device 300.

Anterior vertical opening segment 214 of lower torso device 204 has mounted therein zipper closure 280. Anterior vertical opening segment 258 of upper torso device 202 has mounted therein zipper closure 282. Zipper fasteners 396 and 398 are each actually two fasteners, mounted back to back, so that movement of either will simultaneously close or fasten zipper closures 394, 280 and 282.

Trouser segment 404 of device 300 includes pants legs 302. A zipper or snap mechanism (not shown) can optionally be located on the internal aspect of legs 302 and the crotch to permit easy access for excretory bodily functions.

Jump suit device 300 can have two or more layers of material (high resistant, such as, Nomex ®) to protect the shoulders and midback. The front panels of jump suit 300 (the torso region) can provide projectile and explosion resistance by having one or more layers of Nomex ® or similar material. The overall construction of jump suit device 300 include Nomex ® and similar materials to provide high resistance and durability, and fire resistance/proofing over the entire torso and limbs. The gloves and boots, where possible, can also be made of Nomex ® or similar material.

Kelvar ® is the registered trademark for the high strength, lightweight aramid fiber manufactured by E. I. duPont de Nemours & Company. This material is woven into a fabric and, in the form of a multiple layered vest provides excellent protection against projectiles fired from common handguns (as does Nomex ® and Nomex III). Under no circumstances should fabrics of Kevlar ® be commercially laundered or bleached. Machine washing is acceptable and the vest should be thoroughly rinsed to remove detergents and dried before use. Kelvar ® fibers break upon bending, etc., so Kelvar ® should not be used for knees, elbows, etc. Kelvar ® can be used in the vest areas.

Nomex ® is the registered trademark for aramid fiber manufactured by E. I. duPont de Nemours & Company which is 65 percent nylon and the rest polyester (35 percent) with a silicone additive which chemically becomes part of the fabric. Nomex ® has a tensile strength which is almost that of nylon and has a very high abrasive strength or resistance. There are several types of weaves and weight of threads commercially available. Nomex ® is soft to the skin, is water resistant, and can be washed in hot water and detergent and the dried with the hot level of a drier (such helps refirm the fabricweave). Nomex® fabrics are sewn with Nomex® thread.

Nomex III is an interweave of five percent of Kelvar® and the rest Nomex®. It prevents a shrinkage problem (up to 25 percent) which Nomex® has when heated.

Figure 6:
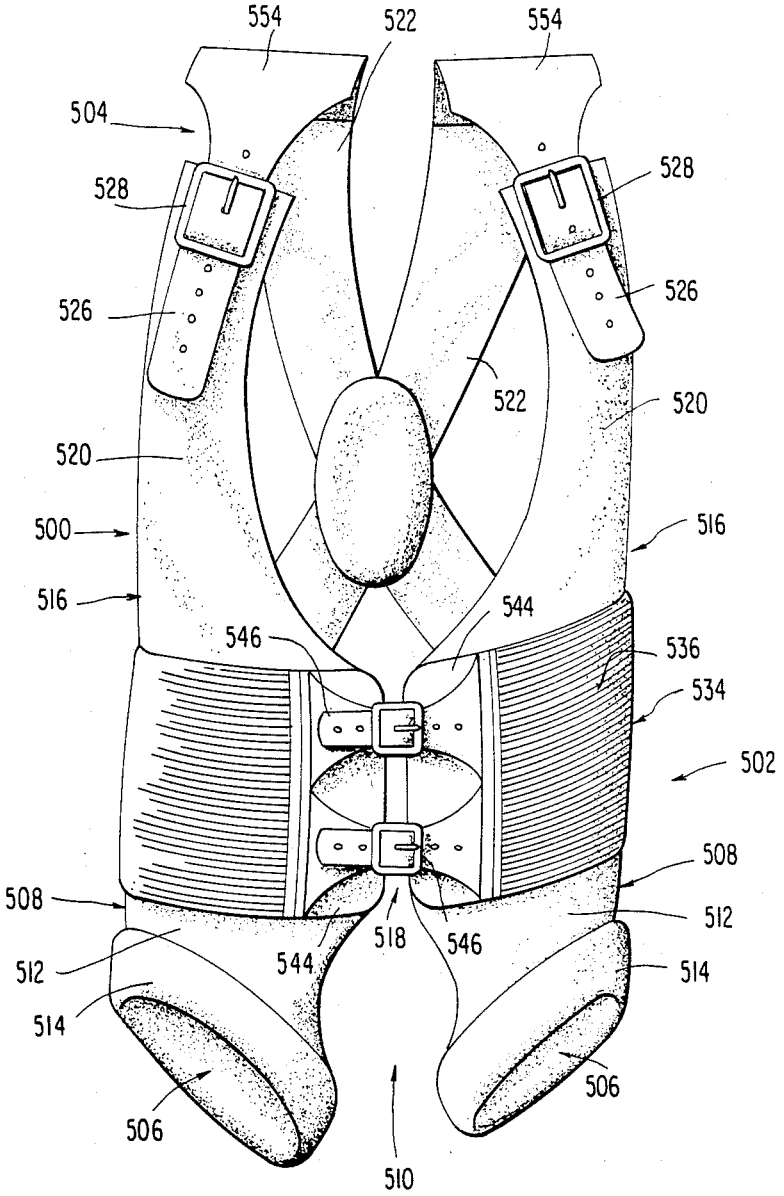
FIG. 6 is a front perspective view of another version of the lifting device of this invention.

In FIG. 6, numeral 500 represents preferred version of the "LIFT-O-MATIC" device of this invention, which acts as a lifting assistance mechanism. Support device 500 includes lower torso body girdling (support) device 502 and upper support structure 504. Lower torso device 502 generally has the shape of shorts, having leg openings 506 in short legs 508, but is crotchless (see numeral 510). Each short leg 508, has nonelastic section 512 which circumscribes the lower portion of the body torso and padded ring 514 which is a padded non-elastic leg reinforcement ring. Padded rings 514 defer of transmit the stress of the lifting mechanism to the upper legs. Non-elastic section 512 extends upwards around the waist forming torso section 516. Torso section 516 is also formed of non-elastic material. Torso section 516 (and non-elastic section 512) have front slit 518.

Figure 7:
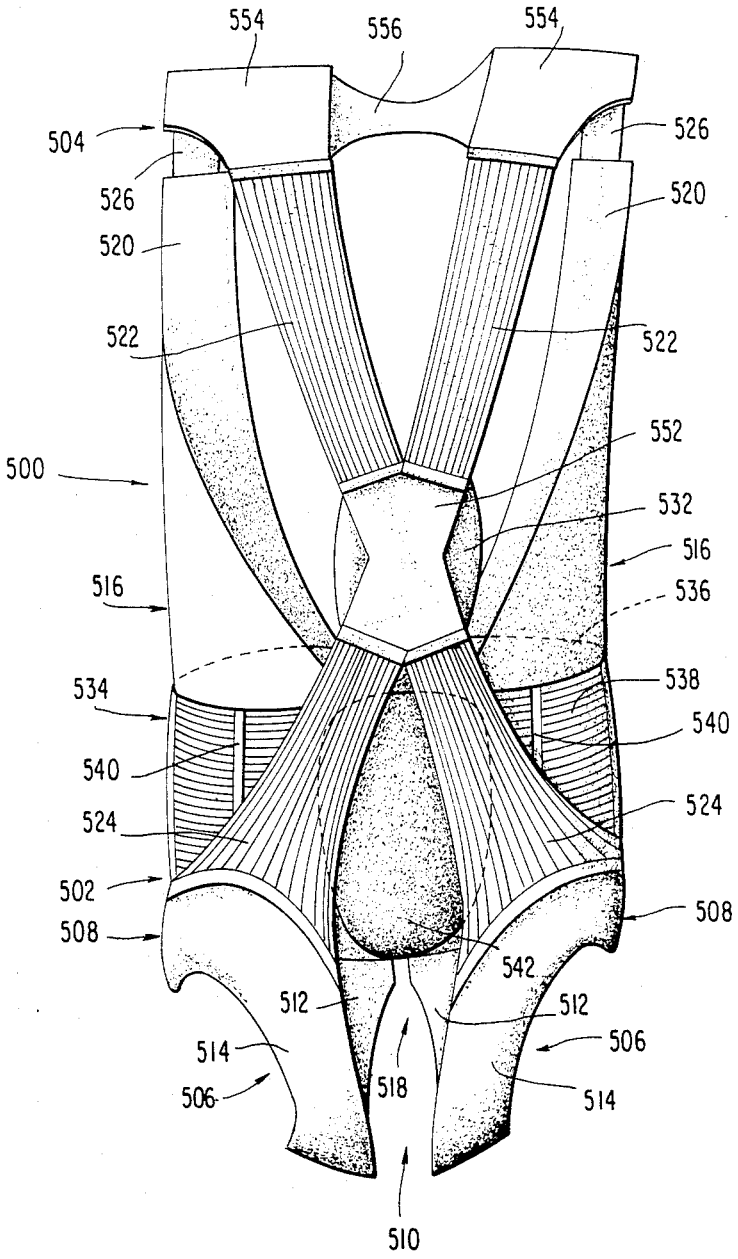
FIG. 7 is a back perspective view of the special body lifting device shown in FIG. 6.
Figure 8:
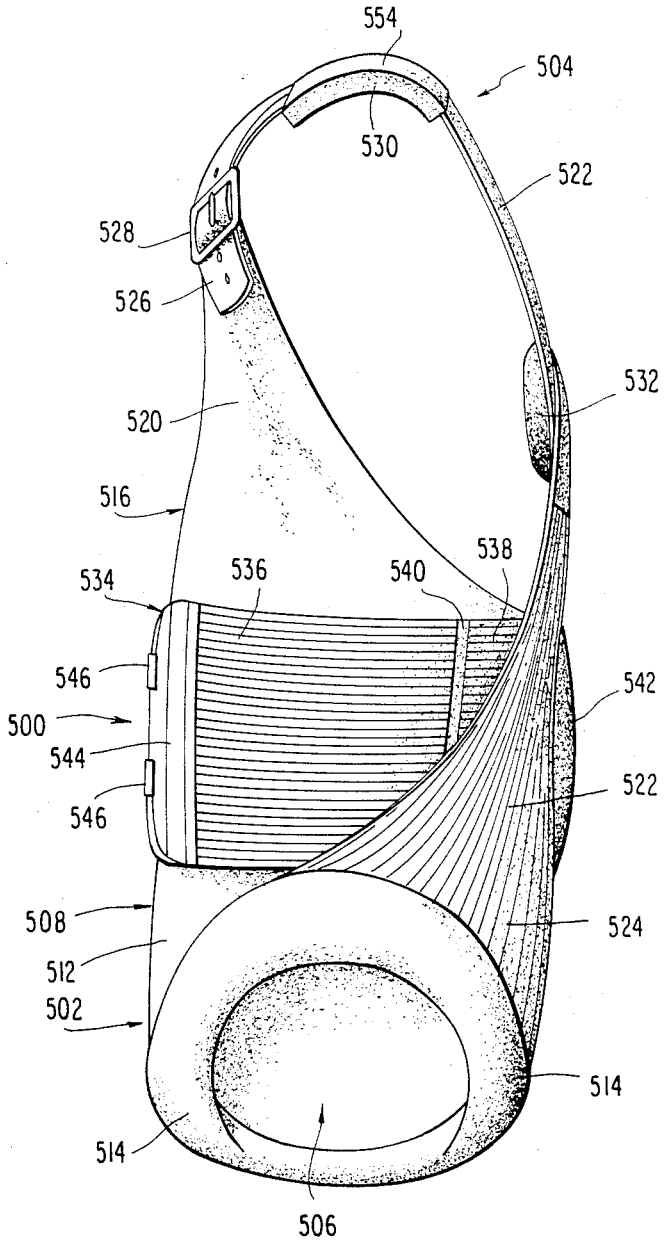
FIG. 8 is a side perspective view of the special body lifting device shown in FIG. 6.

Torso section 516 narrows down on each side frontal region as it goes up the body to form two front strap segments 520. Referring to FIG. 6, elastic back straps 522 are crisscrossed and held in place by fabric X-unit 552, which is sewn on the top and bottom to each back strap 522. Bottom segment 524 of each back strap 522 flairs out and is attached to the side and back portions of a padded ring 514 (see FIGS. 7 and 8). The end portion of each elastic back strap 522 is non-elastic and has wide shoulder portion 554 and tongue 526. Tongue 526 has holes therein and adjustably fits in buckle 528, whereby providing adjustment for length of body torso. Cushioned shoulder pad 530 is attached under shoulder portion 554.

On the inner side of X-unit 524 (and straps 522) is located crossover cushioned pad 532, which provides lower thoracic support. Girdle unit 534 circumscribes and is attached to the waist portion of device 500. Girdle unit 534 has elastic front portion 536 and back portion 538. Elastic front portion 536 helps provide low back support and is part of the lifting mechanism. Back portion 536 provides low back support and is elastic, but contains vertical cloth strap 540 which prevents vertical stretching while allowing horizontal stretching of the elastic fabric. Back portion 536 is positioned between back straps 522 and torso section 516. Low back support cushion or pad 542 is located between back portion 536 and back straps 522. Pad 542 is a lumbrosacral pad and is part of the lumbrosacral support. Girdle unit 534 is also slit in the front and each end thereof is composed of non-elastic portion 544 (for example made of canvas). Two adjustable buckle units 546 are affixed on portions 544 so as to adjustably affix girdle unit 534 (and device 500) around the user. Optionally strip 556 attached to shoulder portions 554 can be used to keep back straps 522 from separating too far.

Torso stress reduction device 500 can be used separately. When device 500 is used with jump suit 300, detachable attachment means must be provided to attach girdle unit 534 to jump suit 300. A series of snaps (not shown) can be provided on the vertical outer edges of the face of non-elastic portions 544 and on the inside of jump suit 300. Preferably zipper means is provided on girdle unit 534—reference is made to FIG. 9.

Zipper flaps 548 are attached to the vertical outer edges of the face of non-elastic portions 544. Zipper closure 550 is affixed to the inner vertical edges of flaps 548. Zipper fasteners 396 and 398 are actually two fasteners, mounted back to back, so that movement of either will simultaneously close or fasten zipper zlosure 394 and 550.

Referring to FIG. 10, shoulder cover 410 fits over the shoulders and extends down the back and front of the user. Shoulder cover 410 fits over jump suit 300 and can be attached (e.g., sewn) thereto. Shoulder cover 410 is constructed of Nomex® or a like material to provide protection from projectiles (e.g., bullets, shrapnel, rocks, etc.) for the uppoer portions of the torso.

What is claimed is:

1. A body-fitting device for aiding the user during lifting or prolonged bending comprising:

(a) a pants or drawers section shaped for fitting around the lower torso, having a reinforced segment arounds its top rim and having a vertical opening which extends part of the way down the front portion thereof, thereby allowing easy removal or donning of the lower torso section, the vertical opening having closure means capable of providing temporary and secure closure;

(b) an upper section shaped for fitting around the chest region of the upper torso, and having a vertical opening which extends down the entire front portion thereof, the vertical opening having closure means capable of providing temporary and secure closure;

(c) two strap means, the bottom edge of each strap means being attached to the top rim of the back portion of lower torso section (a), the center portion of each strap means being adapted for attachment to the back portion of the upper torso section (b) in a slidable or movable manner, and the upper portion of each strap means looping over the top of upper torso section (b) from the back portion thereof, thereby forming a shoulder strap section; and (d) adjustable attachment means for adjustably attaching the front part of the upper portion of each strap means to one of front portions of upper torso section (b); each of the two adjustable attachment means being mounted on one of the front portions of upper torso section (b).

2. The body-fitting device as claimed in claim 1 wherein the closure means of lower torso section (a) is a zipper.

3. The body-fitting device as claimed in claim 1 wherein the closure means of upper torso section (b) is a zipper.

4. The body-fitting device as claimed in claim 1 wherein there is an elastic segment in the upper torso section (b) located under either or both arms of the user.

5. The body-fitting device as claimed in claim 1 wherein adjustable attachment means (d) are buckles.

6. The body-fitting device as claimed in claim 1 wherein each of strap means (c) contains one or more elastic segments situated in the back region of the user.

7. A one-piece garment device containing safety and injury-prevention features comprising:

(a) a one-piece garment having full sleeves and legs, the one-piece garment having a vertical opening in the front portion thereof which extends from the next opening thereof to the crotch region thereof;

(b) closure means associated with vertical opening (a) capable of providing temporary and secure closure of vertical opening (a);

(c) a pants or drawers section forming a lower torso section, shaped for having a reinforced segment around its top rim and having a vertical opening which extends part of the way down the front portion thereof, thereby allowing easy removal or donning of the lower torso section, the lower torso section being positioned inside of garment (a), and closure means (b) also being capable of providing temporary and secure closure of vertical opening (c) so that the front of the lower torso section is temporarily and securely attached to the front portion of garment (a);

(d) an upper section shaped for fitting around the chest region of the upper torso, and having a vertical opening which extends down the entire front portion thereof, the upper torso section being positioned inside of garment (a), and closure means (b) also being capable of providing temporary and secure closure of vertical opening (d) so that the front of the upper torso section is temporarily and securely attached to the front portion of garment (a);

(e) two strap means, the bottom edge of each strap means being attached to the top rim of the back portion of lower torso section (c), the center portion of each strap means being attached in a slidable or movable manner to the back portion of the upper torso section (d), and the upper portion of each strap means looping over the top of upper torso section (d) from back portion thereof to the front portion thereof, thereby forming a shoulder strap section; and (f) adjustable attachment means for adjustably attaching front part of the upper portion of each strap means to one of front portions of upper torso section (d), each of the two adjustable attachment means being mounted on one of the front portions of upper torso section (d).

8. The one-piece garment device as claimed in claim 7 wherein closure means (a) is a zipper capable of simultaneously closing vertical openings (a), (c) and (d).

9. The one-piece garment as claimed in claim 7 wherein there is an elastic segment in the upper torso section (d) located under either or both arms of the user.

10. The one-piece garment as claimed in claim 7 wherein adjustable attachment means (f) are buckles.

11. The one-piece garment as claimed in claim 7 wherein each of strap means (e) contains one or more elastic segments situated in the back region of the user.

12. The one-piece garment as claimed in claim 7 wherein support elements are located on each of the knee and elbow joint portions of garment (a) as part of garment (a), each of the support element having a flexible main sheet of heavy duty material, padding on part of the surface of the main sheet and elastic material in the side and/or back joint bending portions of the main sheet.

13. The one-piece garment as claimed in claim 12 wherein garment (a) includes strap-buckle means adapted to adjust the tension on the support elements.

14. The one-piece garment as claimed in claim 7 wherein garment (a) has apertures in the chest region which are adapted to allow access to adjustable attachment means (f).

15. The one-piece garment as claimed in claim 7 wherein support elements are located at the wrists, each of the support elements having a flexible main sheet and strap-buckle means on the main sheet to adjust the tension on the support element.

16. The one-piece garment as claimed in claim 7 wherein an adjustable utility belt is positioned around the waist region of garment (a) as part of garment (a).

17. The one-piece garment as claimed in claim 7 wherein a battery pack is mounted on the utility belt.

18. Combination for use by miners, other industrial works, military personnel or the like, comprising:

I. a one-piece garment device containing safety and injury-prevention features comprising:

(a) a one-piece garment having full sleeves and legs, the one-piece garment having a vertical opening in the front portion thereof which extends from the neck opening thereof to the crotch region thereof;

(b) closure means associated with vertical opening (a) capable of providing temporary and secure closure of vertical opening (a);

(c) a pants or drawers section forming a lower torso section, shaped for having a reinforced segment around its top rim and having a vertical opening which extends part of the way down the front portion thereof, thereby allowing easy removal or donning of the lower torso section, the lower torso section being positioned inside the garment (a), and closure means (b) also being capable of providing temporary and secure closure of vertical opening (c) so that the front of the lower torso section is temporarily and securely attached to the front portion of garment (a);

(d) an upper section shaped for fitting around the chest region of the upper torso, and having a vertical opening which extends down the entire front portion thereof, the upper torso section being positioned inside of garment (a), and closure means (b) also being capable of providing temporary and secure closure of vertical opening (d) so that the front of the upper torso section is temporarily and securely attached to the front portion of garment (a);

(e) two strap means, the bottom edge of each strap means being attached to the top rim of the back portion of lower torso section (c), the center portion of each strap means being adapted for attachment to the back portion of the upper torso section (d) in a slidable manner, and the upper portion of each strap means looping over the top of upper torso section (d) from back portion thereof, thereby forming a shoulder strap section; and (f) adjustable attachment means for adjustably attaching front part of the upper portion of each strap means to one of front portions of upper torso section (d), each of the two adjustable attachment means being mounted on one of the front portions of upper torso section (d);

II. an adjustable utility belt positioned around the waist region of garment (a);

III. a battery pack mounted on the utility belt; and

IV. a helmet containing safety features comprising:

(g) a helmet which is impact resistant and which has two ear-covering segments extending below the ear lobes of the user and a back segment which extends to or below the base of the skull of the user, each ear-covering segment having an ear hole therein;

(h) an optional front brim on the helmet;

(i) a front lamp mounted on the optional front of the helmet or on the helmet above the optional front brim or the rim when there is not any front brim;

(j) tubing mounted on the top of the helmet and extending over the top ridge or portion of the helmet, the tubing extending from front lamp (i) to the back rim of the helmet;

(k) two side lamps, one mounted on each ear-covering segment of the helmet above the ear hole therein;

(l) two tubing segments mounted on the top of the helmet, each extending from one of side lamp (k) to tubing (j);

(m) an electronic-pulsed and/or frequency-variable signaling device or transmitter mounted on tubing (j), the electronic signaling device being capable of periodically emitting an electrical signal which is capable of being detected by a receiver;

(n) electrical cable which is electrically connected to front lamp (i), two side lamps (k) and transmitter (m), and which is located in and extends through tubing (j) and two tubing segments (1); and (o) an electrical connector attached to the end of electrical cable (n) which exits out of the end of tubing (j) the electrical connector being capable of being resistant to accidental separation from electrical connection to said battery pack.

* * * * *